US011753228B2

(12) United States Patent
Busenitz

(10) Patent No.: US 11,753,228 B2
(45) Date of Patent: Sep. 12, 2023

(54) ADAPTIVE PINSCREEN TRANSPORT CASE FOR CLASSIFIED ARTICLES

(71) Applicant: Honeywell Federal Manufacturing & Technologies, LLC, Kansas City, MO (US)

(72) Inventor: Clark Andrew Busenitz, Mission, KS (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 41 days.

(21) Appl. No.: 17/513,970

(22) Filed: Oct. 29, 2021

(65) Prior Publication Data

US 2023/0134210 A1 May 4, 2023

(51) Int. Cl.
*B65D 81/05* (2006.01)

(52) U.S. Cl.
CPC ..... *B65D 81/05* (2013.01); *B65D 2581/051* (2013.01)

(58) Field of Classification Search
CPC ..... B65D 81/1075; B65D 81/133; B65D 2581/051; B65D 81/05
USPC ..... 206/583, 592, 591
See application file for complete search history.

(56) References Cited

U.S. PATENT DOCUMENTS 2,754,708 A 7/1956 Peterson
5,011,207 A * 4/1991 Stevens ..... B25J 15/106 901/39
5,641,068 A * 6/1997 Warner ..... B65D 5/509 206/593
5,673,795 A * 10/1997 Clatanoff ..... H05K 9/0067 174/521
6,298,587 B1 * 10/2001 Vollom ..... G01B 5/207 33/561.1
6,843,458 B1 * 1/2005 Robinson ..... A47G 23/0216 248/314
7,654,021 B2 * 2/2010 Kleyman ..... G01B 5/207 33/561.1
9,358,930 B1 * 6/2016 Sic ..... B60R 7/06
10,213,913 B2 * 2/2019 Pang ..... B65D 25/106
10,351,287 B2 * 7/2019 Eberbach ..... B65B 55/20
10,457,419 B2 * 10/2019 McChesney ..... B64F 1/0299
10,759,025 B2 9/2020 Atwater et al.
(Continued)

FOREIGN PATENT DOCUMENTS

WO WO9802262 1/1998

*Primary Examiner* — Steven A. Reynolds
(74) *Attorney, Agent, or Firm* — Hovey Williams LLP

(57) ABSTRACT

An article transport case comprising an outer shell including opposing sections, first and second pinscreen assemblies, and first and second securement mechanisms. The pinscreen assemblies each include a frame, a securement plate, and a number of pins. The first and second securement mechanisms are configured to be in a secured configuration to retain the first and second sections in a closed configuration and keep the securement plates in a secured position thereby restraining the pins against the article in an article conforming arrangement. The securement plates are in an unsecured position so that the pins are free to translate longitudinally when the securement mechanisms are in an unsecured configuration such that the pins are not restrained in the article conforming arrangement when the shell is open.

9 Claims, 6 Drawing Sheets

(56) References Cited

U.S. PATENT DOCUMENTS

| | | | | |
|---|---|---|---|---|
| 11,351,902 | B2 * | 6/2022 | Benliyan | B60N 3/104 |
| 2003/0130817 | A1 | 7/2003 | Page | |
| 2017/0369225 | A1 * | 12/2017 | Eberbach | B65B 61/22 |

* cited by examiner

ADAPTIVE PINSCREEN TRANSPORT CASE FOR CLASSIFIED ARTICLES

GOVERNMENT INTERESTS

This invention was made with Government support under Contract No.: DE-NA-0002839 awarded by the United States Department of Energy/National Nuclear Security Administration. The Government has certain rights in the invention.

BACKGROUND

Securable transport cases are often used to transport a classified article. Molding or shaped inserts may also be used to fully support a fragile or sensitive classified article. Unfortunately, molding and shaped inserts may provide information about the classified article such as its shape and size when the transport case is opened. Molding and shaped inserts also can only be used with specific articles.

SUMMARY OF THE INVENTION

Embodiments of the present invention solve the above-mentioned problems and provide a distinct advance in the art of secure transport cases. More particularly, the present invention provides a transport case (hereinafter "case") that completely obscures an article when closed and is completely devoid of information that could be used to identify any aspect of the article when open. The case can also be used with various articles.

An embodiment of the invention is a case broadly comprising an outer shell, first and second inner brackets, first and second pinscreen assemblies, and first and second securement mechanisms. The case may be used to securely transport classified or sensitive articles without having to classify the case itself.

The outer shell includes opposing first and second clamshell sections configured to be opened and closed. The outer shell may also include a handle for carrying the case. The outer shell forms an inner chamber for securing and transporting an article.

The first and second sections are substantially similar so only the first section will be described. The first section has a bottom wall, sidewalls, and an open top, and includes an anchor pin, a guide, and a shell aperture, with the guide and shell aperture being on an opposite side of the first section relative to the anchor pin. The shell aperture may include threading for receiving a threaded fastener.

The first inner bracket is nestled in an inner chamber portion formed by the first section of the outer shell. The first inner bracket is shiftable between a released configuration and a braced configuration, the purpose of which will be described in more detail below.

The second inner bracket is nestled in an inner chamber portion formed by the second section of the outer shell. The second inner bracket is shiftable between a released configuration and a braced configuration, the purpose of which will be described in more detail below.

The first and second pinscreen assemblies are substantially similar so only the first pinscreen assembly will be described in detail. The first pinscreen assembly is positioned in the inner chamber portion formed by the first section of the outer shell and includes a frame, a securement plate, and a number of pins. The first pinscreen assembly can be positioned in one of a number of positions and orientations relative to the first inner bracket and the outer shell.

The frame includes a backplate, a midplate, a foreplate, and a number of spacers. The frame supports the pins and the securement plate. The backplate is spaced from the midplate and positioned near a bottom wall of the first section of the outer shell. The backplate prevents the pins from backing out of the pinholes (described below) of the midplate, foreplate, and securement plate. The midplate is positioned between the backplate and the foreplate and includes a number of pinholes aligned with pinholes of the foreplate. The midplate and the foreplate sandwich the securement plate. The foreplate is spaced in front of the midplate and includes a number of pinholes aligned with the pinholes of the midplate. The spacers retain spacing between the backplate, midplate, and foreplate.

The securement plate is positioned between the midplate and the foreplate and includes a number of pinholes. The securement plate is configured to translate laterally relative to the pins between an unsecured position and a secured position. The pinholes of the securement plate are configured to be aligned with the pinholes of the midplate and foreplate when the securement plate is in the unsecured position and slightly offset therefrom when the securement plate is in the secured position. Furthermore, an end of the securement plate may extend laterally outward relative to ends of the backplate, midplate, and foreplate when the securement plate is in the unsecured position.

The first securement mechanism includes a first link and a first fastener. The first securement mechanism is positioned on an opposite side of the outer shell relative to the second securement mechanism.

The first link is pivotably attached near its first end to the first section of the outer shell via the anchor pin of the first section and includes a link aperture near its second end. The first link is configured to be positioned in the guide of the second section for the link aperture to align with the shell aperture of the second section.

The first fastener is configured to be inserted into and extend through the link aperture and the shell aperture of the second section and to engage the second inner bracket. The first fastener may be a threaded bolt or screw, a pin, a latch (e.g., case latch, bracket latch, or pin latch), a plug, or the like. The first fastener may also be magnetic.

The second securement mechanism includes a second link and a second fastener. The second securement mechanism is positioned on the opposite side of the outer shell relative to the first securement mechanism.

The second link is pivotably attached near its first end to the second section via the anchor pin of the second section and includes a link aperture near its second end. The second link is configured to be positioned in the guide of the first section for the link aperture to align with the shell aperture of the first section.

The second fastener is configured to be inserted into and extend through the link aperture and the shell aperture of the first section and to engage the first inner bracket. The second fastener may be a threaded bolt or screw, a pin, a latch, a plug, or the like.

In use, the case is opened by separating or parting the first and second sections. The article is then positioned on the pins of the first pinscreen assembly. The second pinscreen assembly is then placed on top of the article so that the of pins of the second pinscreen assembly fall via gravity toward the article in at least a portion of an article conforming arrangement. The second section is then positioned on top of the first section so that the article is completely obscured.

The first link (of the first securement mechanism) is also pivoted until it is in the corresponding guide of the second section of the outer shell so that the corresponding link aperture aligns with the shell aperture of the second section and the second link (of the second securement mechanism) is also pivoted until it is in the corresponding guide of the first section of the outer shell so that the corresponding link aperture aligns with the shell aperture of the first section as the first and second sections are brought together. The first fastener is then inserted into the corresponding link aperture and shell aperture so that it presses against the second inner bracket and shifts the second inner bracket from the released configuration to the braced configuration, with the second inner bracket in turn shifting the securement plate from its unsecured position to its secured position. In doing so, the securement plate of the second pinscreen assembly presses against the corresponding pins and restrains them against the article in the article conforming arrangement. The first securement mechanism, now in a secured configuration, also serves to retain the first and second sections in a closed configuration. Alternatively, magnetism of the first fastener, securement plate, midplate, or pins may be used to lock the pins of the second pinscreen in place.

The case is then overturned so that the pins of the first pinscreen assembly fall via gravity toward the article, in furtherance of the article conforming arrangement. The second fastener is then inserted into the corresponding link aperture and shell aperture so that it presses against the first inner bracket and shifts the first inner bracket from the released configuration to the braced configuration, with the first inner bracket in turn shifting the securement plate from its unsecured position to its secured position. In doing so, the securement plate of the first pinscreen assembly presses against the corresponding pins and restrains them against the article in the article conforming arrangement. The second securement mechanism, now in a secured configuration, also serves to retain the first and second sections in the closed configuration. Alternatively, magnetism of the first fastener, securement plate, midplate, or pins may be used to lock the pins of the first pinscreen in place.

The case may now be carried with the article supported in the article conforming arrangement and secured in the inner chamber with complete obscurity. Additional security such as a lock or a disguise (e.g., to make the case appear to be designed for an inconsequential article) may be added.

To remove the article from the case, the first and second securement mechanisms must be reverted to an unsecured configuration. Specifically, the first fastener (of the first securement mechanism) is withdrawn from the shell aperture of the second section of the outer shell. This releases pressure from the second inner bracket and hence the securement plate of the second pinscreen assembly, which frees the pins of the second pinscreen assembly to translate longitudinally. Similarly, the second fastener of the second securement mechanism is withdrawn from the shell aperture of the first section of the outer shell. This releases pressure from the first inner bracket and hence the securement plate of the first pinscreen assembly, which frees the pins of the first pinscreen assembly to translate longitudinally. This ensures the pins of the first pinscreen assembly and the pins of the second pinscreen assembly are not restrained in the article conforming arrangement when the case is in the open configuration.

The first and second sections and the first and second pinscreen assemblies are then separated to provide access to the article. The article may then be removed from the case, which also resets the pins. The pinscreen assemblies may also be removed from the first and second sections. In these ways, the pinscreen assemblies and the case by itself are completely devoid of information that could be used to identify any aspect of the article.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
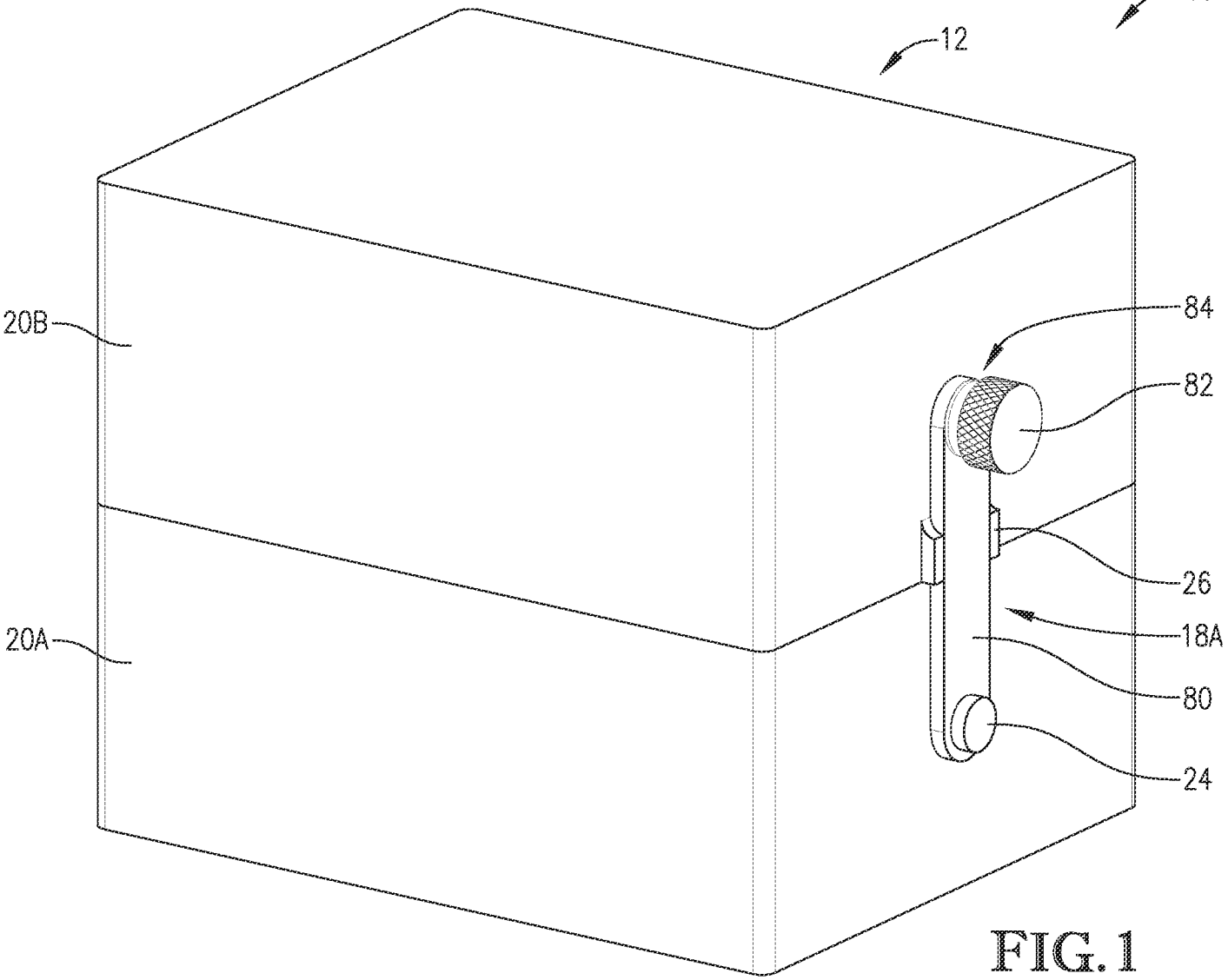
FIG. 1 is a perspective view of a case constructed in accordance with an embodiment of the invention.
Figure 2:
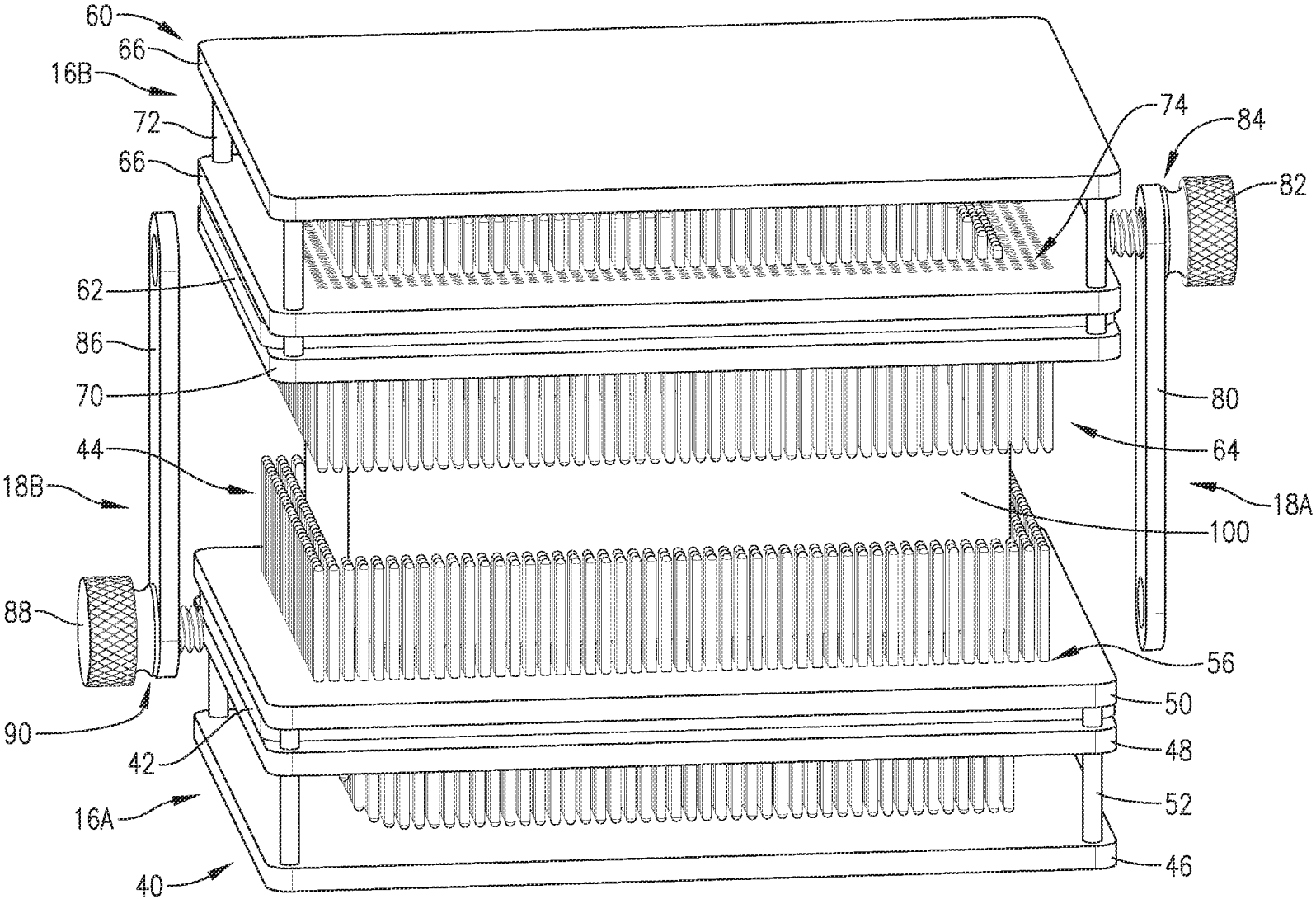
FIG. 2 is a perspective view of select components of the case of FIG. 1.
Figure 3:
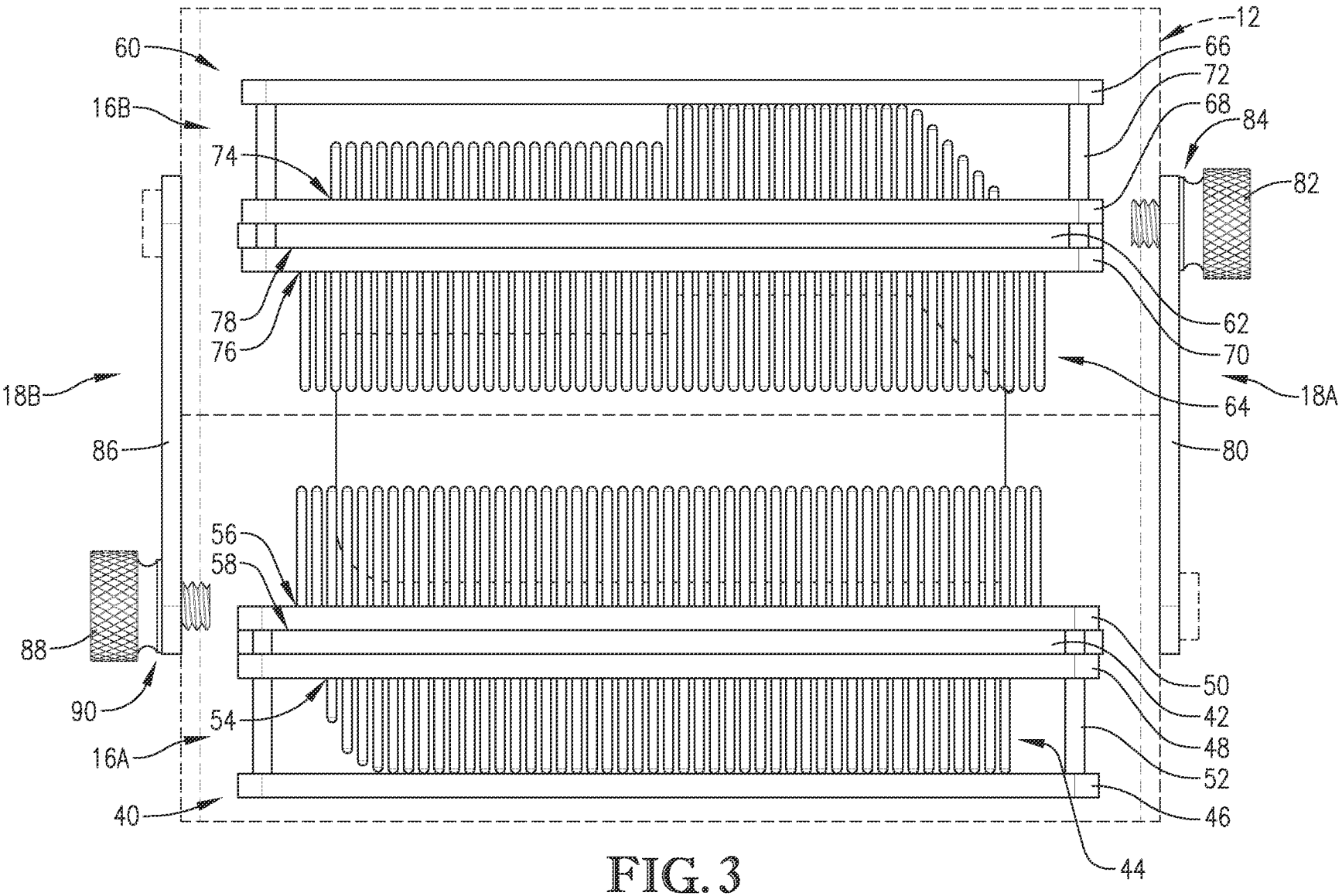
FIG. 3 is an elevation view of the select components of FIG. 2.
Figure 4:
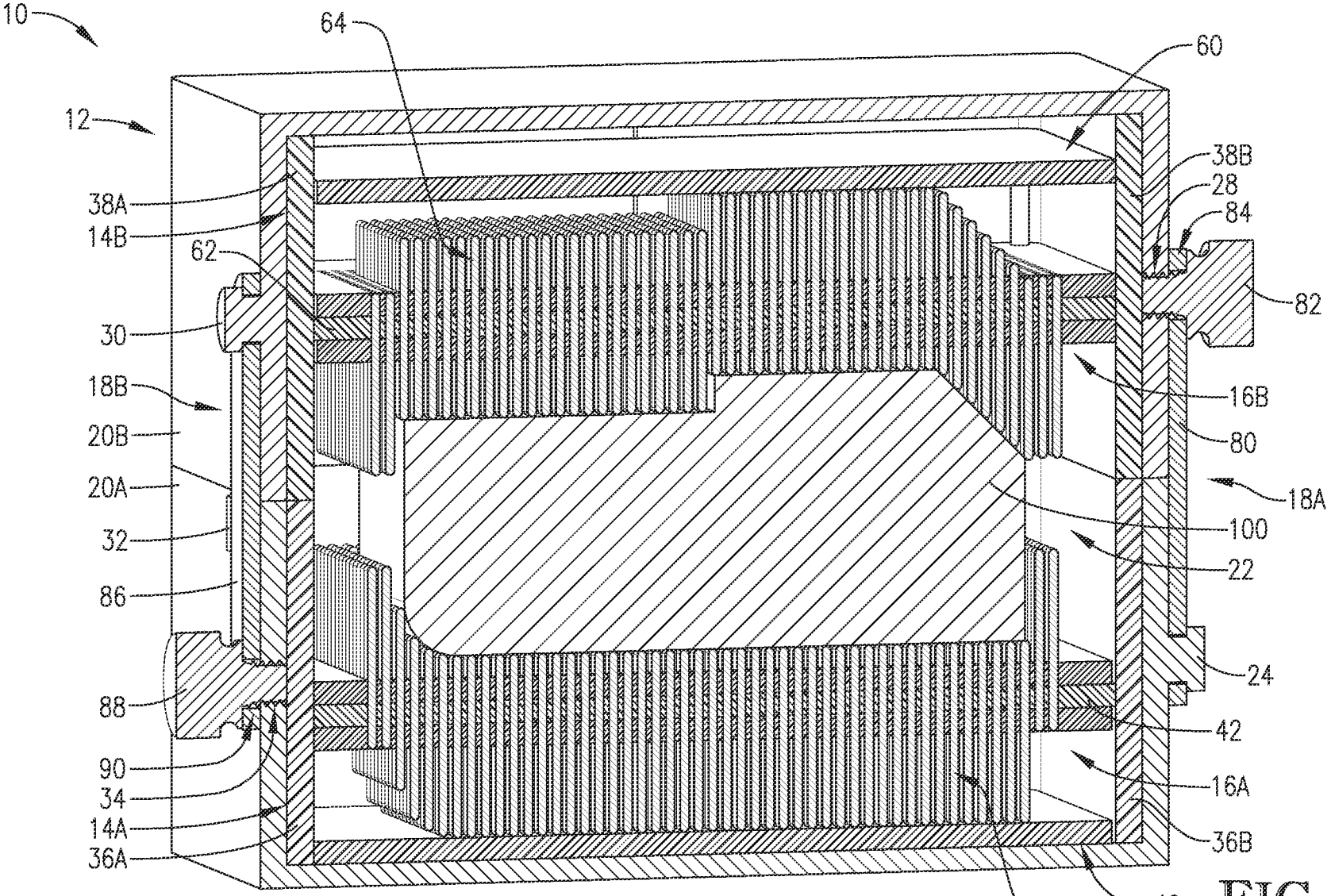
FIG. 4 is a perspective cutaway view of select components of the case of FIG. 1.

The drawing figures do not limit the current invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to the drawing figures, a transport case 10 (hereinafter "case 10") constructed in accordance with an embodiment of the invention is illustrated. The case 10 broadly comprises an outer shell 12, first and second inner brackets 14A,B, first and second pinscreen assemblies 16A, B, and first and second securement mechanisms 18A, B.

The outer shell 12 includes opposing first and second sections 20A,B and is configured to be in an open configuration and a closed configuration. The outer shell 12 may also include a handle for carrying the case 10. The outer shell 12 forms an inner chamber 22 when in the closed configuration. The outer shell 12 may be opaque to completely obscure the contents in the inner chamber 22.

The first section 20A may be a clamshell, a box portion, a partial housing, or the like. In one embodiment, the first section 20A is a bottom part of the outer shell 12. For example, the first section 20A may include a bottom wall, sidewalls, and an open top. The first section may include an anchor pin 24, a guide 26, and a shell aperture 28, with the guide 26 and shell aperture 28 being on an opposite side of the first section 20A relative to the anchor pin 24. The shell aperture 28 may include threading for receiving a threaded fastener.

The second section 20B may be a clamshell, a box portion, a partial housing, or the like. In one embodiment, the second section 20B is a top part of the outer shell 12. For example, the second section 20B may include a top wall, sidewalls, and an open bottom. The second section 20B may include an anchor pin 30, a guide 32, and a shell aperture 34, with the guide 32 and shell aperture 34 being on an opposite side of the second section 20B relative to the anchor pin 30. The shell aperture 34 may include threading for receiving a threaded fastener.

The first inner bracket 14A may be nestled in an inner chamber portion formed by the first section 20A of the outer shell 12 and may include first and second sections 36A,B configured to sandwich the first pinscreen assembly 16A. Alternatively, only one bracket section may be used. The first inner bracket 14A, and at least one of the first and second sections 36A,B in particular, may be shiftable between a released configuration and a braced configuration, the purpose of which will be described in more detail below. The first inner bracket 14A may include geometry to retain the first inner bracket 14A in the first section 20A of the outer shell 12.

The second inner bracket 14B may be nestled an inner chamber portion formed by the second section 20B of the outer shell 12 and may include first and second sections 38A,B configured to sandwich the second pinscreen assembly 16B.

Alternatively, only one bracket section may be used. The second inner bracket 14B, and at least one of the first and second sections 38A,B in particular, may be shiftable between a released configuration and a braced configuration, the purpose of which will be described in more detail below. The second inner bracket 14B may include geometry to retain the second inner bracket 14B in the second section 20B of the outer shell 12.

The first pinscreen assembly 16A may be positioned in the inner chamber portion formed by the first section 20A of the outer shell 12 and may include a frame 40, a securement plate 42, and a plurality of pins 44. The first pinscreen assembly 16A may be positioned in one of a plurality of positions and orientations relative to the first inner bracket 14A and the outer shell 12. The first pinscreen assembly 16A may also include geometry to retain it in the first section 20A of the outer shell 12.

The first pinscreen assembly 16A could even be positioned in one of a plurality of positions and orientations within the inner chamber portion formed by the second section 20B, which may be useful for small articles. In other words, the pinscreen assemblies 16A,B are not limited to being positioned in particular inner chamber portions. In one embodiment, the first pinscreen assembly 16A may be slid along rods and locked in place when the rods are shifted laterally.

The frame 40 may include a backplate 46, a midplate 48, a foreplate 50, and a plurality of spacers 52. The frame 40 supports the plurality of pins 44 and the securement plate 42.

The backplate 46 may be spaced from the midplate 48 and positioned near a bottom wall of the first section 20A of the outer shell 12. The backplate 46 prevents the plurality of pins 44 from backing out of the pinholes (described below) of the midplate 48, foreplate 50, and securement plate 42.

The midplate 48 may be positioned between the backplate 46 and the foreplate 50 and may include a plurality of pinholes 54 aligned with pinholes of the foreplate 50. The midplate 48 and the foreplate 50 sandwich the securement plate 42. The midplate 48 may also or alternatively have magnetic features that can be utilized for pin securement.

The foreplate 50 may be spaced in front of the midplate 48 and may include a plurality of pinholes 56 aligned with the pinholes 54 of the midplate 48. The foreplate 50 and the midplate 48 sandwich the securement plate 42.

The plurality of spacers 52 retain spacing between the backplate 46, midplate 48, and foreplate 50. The plurality of spacers 52 may be rods, screws, pins, or the like.

The securement plate 42 may be positioned between the midplate 48 and the foreplate 50 and may include a plurality of pinholes 58. The securement plate 42 may be configured to translate laterally relative to the plurality of pins 44 between an unsecured position and a secured position. The pinholes 58 of the securement plate 42 may be configured to be aligned with the pinholes 54, 56 of the midplate 48 and foreplate 50 when the securement plate 42 is in the unsecured position and slightly offset therefrom when the securement plate 42 is in the secured position. Furthermore, an end of the securement plate 42 may extend laterally outward relative to ends of the backplate 46, midplate 48, and foreplate 50 when the securement plate 42 is in the unsecured position. The securement plate 42 may also or alternatively have magnetic features that may be utilized for pin securement.

The securement plate 42 may be configured to be pulled instead of pushed and/or could be made out of a relatively soft material to ensure contact with each pin. This may alleviate pins not locking due to slight misalignment.

The second pinscreen assembly 16B may be positioned in the inner chamber portion formed by the second section 20B of the outer shell 12 and may include a frame 60, a securement plate 62, and a plurality of pins 64. The second pinscreen assembly 16B may be positioned in one of a plurality of positions and orientations relative to the second inner bracket 14B and the outer shell 12. The second pinscreen assembly 16B may also include geometry to retain it in the second section 20B of the outer shell 12.

The second pinscreen assembly 16B could even be positioned in one of a plurality of positions and orientations within the inner chamber portion formed by the first section 20A, which may be useful for small articles. In other words, the pinscreen assemblies 16A, B are not limited to being positioned in particular inner chamber portions. In one embodiment, the second pinscreen assembly 16B may be slid along rods and locked in place when the rods are shifted laterally.

The frame 60 may include a backplate 66, a midplate 68, a foreplate 70, and a plurality of spacers 72. The frame 60 supports the plurality of pins 64 and the securement plate 62.

The backplate 66 may be spaced from the midplate 68 and positioned near a bottom wall of the second section 20B of the outer shell 12. The backplate 66 prevents the plurality of pins 64 from backing out of the pinholes (described below) of the midplate 68, foreplate 70, and securement plate 62.

The midplate 68 may be positioned between the backplate 66 and the foreplate 70 and may include a plurality of pinholes 74 aligned with pinholes of the foreplate 70. The midplate 68 and the foreplate 70 sandwich the securement plate 62. The midplate 68 may also or alternatively have magnetic features that can be utilized for pin securement.

The foreplate 70 may be spaced in front of the midplate 68 and may include a plurality of pinholes 76 aligned with the pinholes 74 of the midplate 68. The foreplate 70 and the midplate 68 sandwich the securement plate 62.

The plurality of spacers 72 retain spacing between the backplate 66, midplate 68, and foreplate 70. The plurality of spacers may be rods, screws, pins, or the like.

The securement plate 62 may be positioned between the midplate 68 and the foreplate 70 and may include a plurality of pinholes 78. The securement plate 62 may be configured to translate laterally relative to the plurality of pins 64 between an unsecured position and a secured position. The pinholes 78 of the securement plate 62 may be configured to be aligned with the pinholes 74, 76 of the midplate 68 and foreplate 70 when the securement plate 62 is in the unsecured position and slightly offset therefrom when the securement plate 62 is in the secured position. Furthermore, an end of the securement plate 62 may extend laterally outward relative to ends of the backplate 66, midplate 68, and foreplate 70 when the securement plate 62 is in the unsecured position. The securement plate 62 may also or alternatively have magnetic features that can be utilized for pin securement.

The securement plate 62 may be configured to be pulled instead of pushed and/or could be made out of a relatively soft material to ensure contact with each pin. This may alleviate pins not locking due to slight misalignment.

The first securement mechanism 18A may include a link 80 and a fastener 82. The first securement mechanism 18A may be positioned on an opposite side of the outer shell 12 relative to the second securement mechanism 18B.

The link 80 may be pivotably attached near its first end to the first section 20A of the outer shell 12 via the anchor pin 24 and may include a link aperture 84 near its second end. The link 80 may be configured to be positioned in the guide 32 of the second section 20B of the outer shell 12 for the link aperture 84 to align with the shell aperture 34 of the second section 20B of the outer shell 12.

The fastener 82 may be configured to be inserted into and extend through the link aperture 84 and the shell aperture 34 of the second section 20B of the outer shell 12 and to engage the second inner bracket 14B. The fastener 82 may be a threaded bolt or screw, a pin, a latch, a plug, a magnetic fastener, or the like. The fastener 82 may include a grip or knurling for aiding in securement.

The second securement mechanism 18B may include a link 86 and a fastener 88. The second securement mechanism 18B may be positioned on the opposite side of the outer shell 12 relative to the first securement mechanism 18A.

The link 86 may be pivotably attached near its first end to the second section 20B of the outer shell 12 via the anchor pin 30 and may include a link aperture 90 near its second end. The link 86 may be configured to be positioned in the guide 26 of the first section 20A of the outer shell 12 for the link aperture 90 to align with the shell aperture 28 of the first section 20A of the outer shell 12.

The fastener 88 may be configured to be inserted into and extend through the link aperture 90 and the shell aperture 28 of the first section 20A of the outer shell 12 and to engage the first inner bracket 14A. The fastener 88 may be a threaded bolt or screw, a pin, a latch, a plug, a magnetic fastener, or the like. The fastener 88 may include a grip or knurling for aiding in securement.

Use of the case 10 will now be described. First, the first and second sections 20A,B of the outer shell 12 may be separated. The article 100 may then be positioned on the plurality of pins 44 of the first pinscreen assembly 16A. The second pinscreen assembly 16B may then be placed on top of the article 100 so that the plurality of pins 64 fall via gravity toward the article in at least a portion of an article conforming arrangement. The second section 20B of the outer shell 12 may then be positioned on top of the first section 20A of the outer shell 12 so that the article 100 is completely obscured.

The link 80 of the first securement mechanism 18A may then be pivoted until it is in the guide 32 so that the link aperture 84 aligns with the shell aperture 34 of the second section 20B. The fastener 82 may then be inserted into the link aperture 84 and the shell aperture 34 so that it presses against the second inner bracket 14B and shifts the second inner bracket 14B from the released configuration to the braced configuration, with the second inner bracket 14B in turn shifting the securement plate 62 from its unsecured position to its secured position. In doing so, the securement plate 62 presses against the plurality of pins 64 of the second pinscreen assembly 16B and restrains them against the article 100 in the article conforming arrangement. The first securement mechanism 18A, now in a secured configuration, also serves to retain the first and second sections 20A, B in a closed configuration.

The case 10 may then be overturned so that the plurality of pins 44 of the first pinscreen assembly 16A fall via gravity toward the article, in furtherance of the article conforming arrangement. The link 86 of the second securement mechanism 18B may then be pivoted until it is in the guide 26 of the first section 20A of the outer shell 12 so that the link aperture 90 aligns with the shell aperture 28 of the first section 20A. The fastener 88 may then be inserted into the link aperture 90 and the shell aperture 28 so that it presses against the first inner bracket 14A and shifts the first inner bracket 14A from the released configuration to the braced configuration, with the first inner bracket 14A in turn shifting the securement plate 42 from its unsecured position to its secured position. In doing so, the securement plate 42 presses against the plurality of pins 44 and restrains them against the article 100 in the article conforming arrangement. The second securement mechanism 18B, now in a secured configuration, also serves to retain the first and second sections 20A,B in the closed configuration.

The article 100, now supported in the article conforming arrangement and secured in the inner chamber 22 may then be transported with complete obscurity via the case 10. Additional security such as a lock or a disguise (e.g., to make the case appear to be designed for an inconsequential article) may be added.

To remove the article 100 from the case 10, the first and second securement mechanisms 18A,B must be reverted to an unsecured configuration. Specifically, the fastener 82 of the first securement mechanism 18A may be withdrawn from the shell aperture 34 of the second section 20B of the outer shell 12. This releases pressure from the second inner bracket 14B and hence the securement plate 62 of the second pinscreen assembly 16B, which frees the plurality of pins 64 of the second pinscreen assembly 16B to translate longitudinally. Similarly, the fastener 88 of the second securement mechanism 18B may be withdrawn from the shell aperture 28 of the first section 20A of the outer shell 12. This releases pressure from the first inner bracket 14A and hence the securement plate 42 of the first pinscreen assembly 16A, which frees the plurality of pins 44 of the first pinscreen assembly 16A to translate longitudinally. This ensures the plurality of pins 44 of the first pinscreen assembly 16A and the plurality of pins 64 of the second pinscreen assembly 16B are not restrained in the article conforming arrangement when the case 10 is in the open configuration.

The first and second sections 20A,B and the first and second pinscreen assemblies 16A,B may then be separated to provide access to the article 100. The article 100 may then be removed from the case 10, which also resets the plurality of pins 44, 64. In this way, the case 10 by itself is completely devoid of information that could be used to identify any aspect of the article 100.

The case 10 has heretofore been described with first and second sections 20A,B, first and second pinscreen assemblies 16A,B, and first and second securing mechanisms 18A,B, but aspects of the invention may be achieved via a single-piece or multi-piece outer shell, one or several pinscreen assemblies, and one or several securing mechanisms.

The above-described case 10 provides several advantages. For example, the first and second securement mechanisms 18A,B ensure the plurality of pins 44 of the first pinscreen assembly 16A and the plurality of pins 64 of the second pinscreen assembly 16B are not restrained in the article conforming arrangement when the case 10 is in the open configuration. This allows the case 10 by itself to be completely devoid of information that could be used to identify any aspect of articles it contained. The first and second pinscreen assemblies 16A,B allow articles of different sizes and shapes to be support and secured. The first and second pinscreen assemblies 16A,B and the first and second brackets 14A,B may be positioned in one of a plurality of positions, and the plurality of pins 44, 64 can be positioned in different pinholes. These features provide the case 10 more versatility in securing articles of different shapes and further obfuscates the nature of the article being secured.

Figure 6:
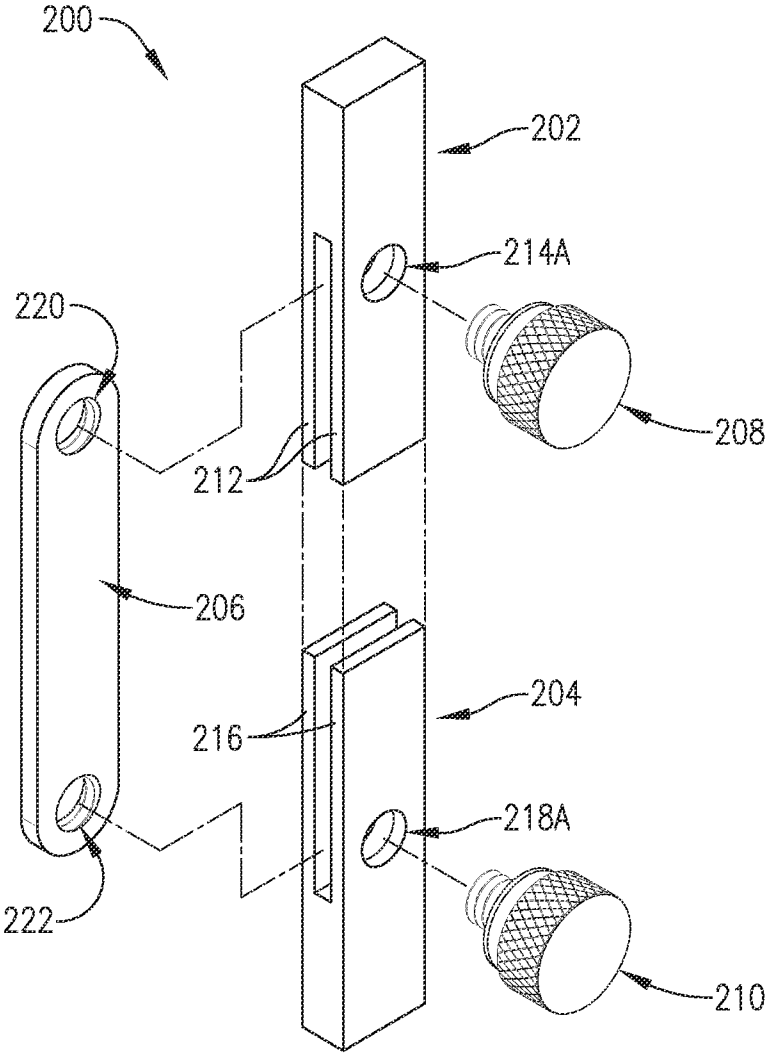
FIG. 6 is a rear perspective exploded view of the securement mechanism of FIG. 5.
Figure 5:
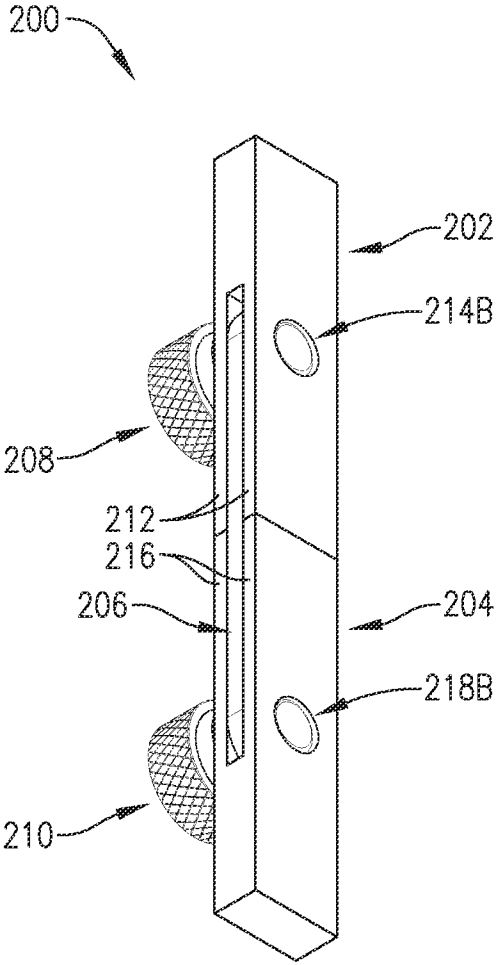
FIG. 5 is a perspective view of a securement mechanism constructed in accordance with another embodiment of the invention.

Turning now to FIGS. 5 and 6, a securement mechanism 200 constructed in accordance with another embodiment of the invention is illustrated. The securement mechanism 200 broadly comprises opposing first and second members 202, 204, an intermediate link 206, and first and second fasteners 208, 210. The securement mechanism 200 may be used instead of previously described securement mechanisms with a transport case as otherwise described herein (e.g., transport case 10).

The first member 202 includes opposing flanks 212 each having apertures 214A,B. The flanks 212 form a space therebetween. The apertures 214A,B may be aligned with each other.

The second member 204 includes opposing flanks 216 each having apertures 218A, B. The flanks 212 form a space therebetween. The apertures 218A, B may be aligned with each other.

The intermediate link 206 includes threaded apertures 220, 222 and may be configured to be positioned in the spaces between the flanks 212, 216. The threaded aperture 220 is configured to be aligned with the apertures 214A,B, and the threaded aperture 222 is configured to be aligned with the apertures 218A,B when the transport case is closed and ready to be secured.

The fasteners 208, 210 may be threaded knobs, bolts, screws, or other similar threaded fasteners. Fastener 208 is configured to be inserted through aperture 214A, threaded aperture 220, and aperture 214B. Fastener 208 must be turned so that its threads engage the threads of threaded aperture 220. Similarly, fastener 210 is configured to be inserted through aperture 218A, threaded aperture 222, and aperture 218B. Fastener 210 must be turned so that its threads engage the threads of threaded aperture 222.

The securement mechanism 200 provides additional security to its transport case. Specifically, the intermediate link 206 must be in place for either of the fasteners 208, 210 to be secured (and hence for the fasteners 208, 210 to engage securement plates of the transport case.

Figure 9:
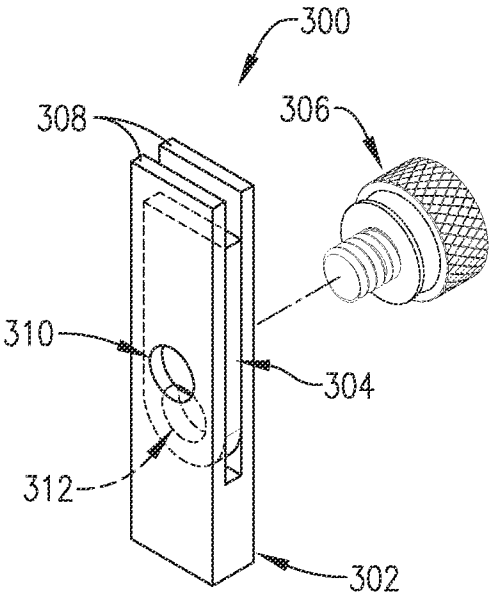
FIG. 9 is another perspective view of the securement mechanism of FIG. 8 with the securement mechanism being in an inverted orientation.
Figure 8:
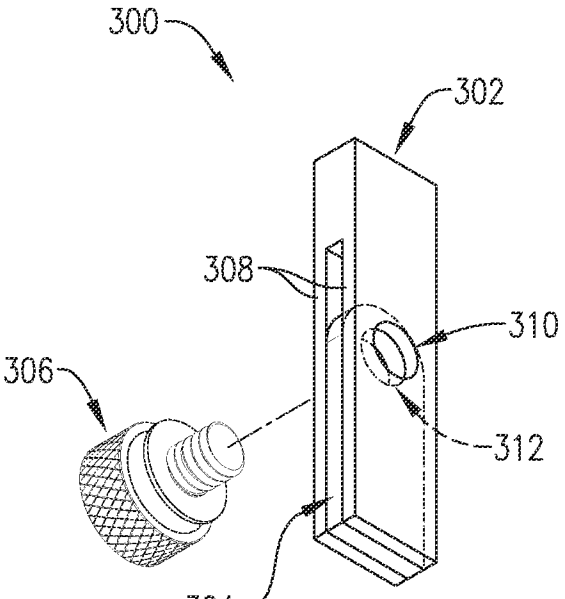
FIG. 8 is another perspective view of the securement mechanism of FIG. 7.
Figure 7:
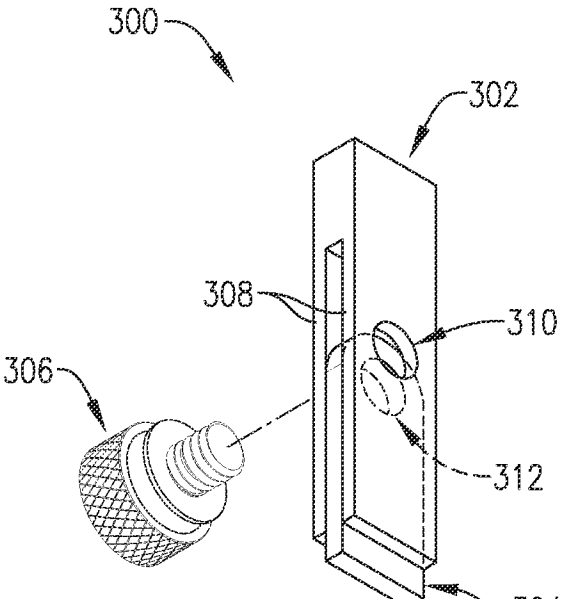
FIG. 7 is a perspective view of a securement mechanism constructed in accordance with another embodiment of the invention.

Turning to FIGS. 7-9, a securement mechanism 300 constructed in accordance with another embodiment of the invention is illustrated. The securement mechanism 300 broadly comprises a first member 302, an intermediate link 304, and a fastener 306. The securement mechanism 300 may be used instead of previously described securement mechanisms with a transport case as otherwise described herein (e.g., transport case 10).

The first member 302 includes opposing flanks 308 each having apertures 310. The flanks 308 form a space therebetween. The apertures 310 may be aligned with each other.

The intermediate link 304 includes an aperture 312 and may be configured to be positioned in the space between the flanks 308. The aperture 312 is configured to be aligned with the apertures 310 when the transport case is closed and ready to be secured.

The fastener 306 may be a threaded knob, bolt, screw, or other similar threaded fastener. Fastener 306 is configured to be inserted through apertures 310 and aperture 312.

In use, the intermediate link 304 is not in position for insertion of fastener 306 unless the transport case is closed, as seen when comparing FIGS. 7 and 8. That is, when the transport case is open, the intermediate link 304 may slide out of position, as shown in FIG. 7. When the transport case is closed, the opposing section of the transport case pushes the intermediate link 304 into the correct position, as shown in FIG. 8. Furthermore, the intermediate link 304 may slide out of position, deeper into the space between flanks 308, when the securement mechanism 300 is inverted, as shown in FIG. 9. As such, the securement mechanism 300 can only be engaged when the transport case is closed and the securement mechanism 300 (and hence a corresponding section of the transport case) is not inverted.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A case for transporting an article, the case comprising:

an outer shell including opposing first and second sections configured to form an inner chamber when the first and second sections are in a closed configuration;

a pinscreen assembly including:

a frame having a plurality of frame pinholes;

a securement plate including a plurality of securement plate pinholes, the securement plate being configured to translate laterally relative to the frame between an unsecured position and a secured position; and a plurality of pins extending through the frame pinholes and the securement plate pinholes;

an inner bracket configured to urge the securement plate from the unsecured position to the secured position; and a securement mechanism configured to be in a secured configuration to retain the first and second sections in the closed configuration and to keep the securement plate in the secured position via the securement mechanism engaging the inner bracket thereby restraining the plurality of pins against the article in an article conforming arrangement to secure the article in the inner chamber for transport, wherein the securement plate is in the unsecured position so that the plurality of pins are free to translate longitudinally when the securement mechanism is in an unsecured configuration such that the plurality of pins are not restrained in the article conforming arrangement when the first and second sections are in an open configuration.

2. The case of claim 1, the second section of the outer shell including a shell aperture, the securement mechanism including:

a link having opposing first and second ends, the link being attached to the first section of the outer shell near the first end and including a link aperture near the second end, and a threaded bolt configured to be inserted through the link aperture and the shell aperture to retain the first and second sections in the closed configuration and to press the threaded bolt against the inner bracket.

3. The case of claim 2, wherein the second section of the outer shell includes a guide configured to hold the link in place to align the link aperture and the shell aperture.

4. The case of claim 2, wherein the link is pivotably attached to the first section of the outer shell.

5. The case of claim 1, wherein the pinscreen assembly can be placed in one of a plurality of positions relative to the inner bracket.

6. The case of claim 1, wherein the plurality of pins can be placed in different ones of the plurality of frame pinholes and plurality of securement plate pinholes.

7. The case of claim 1, wherein the frame includes a backplate configured to prevent the plurality of pins from backing out of the frame pinholes.

8. The case of claim 1, wherein the inner bracket includes first and second sections configured to sandwich the pinscreen assembly.

9. A case for transporting an article, the case comprising:

an outer shell including opposing first and second sections configured to form an inner chamber when the first and second sections are in a closed configuration;

a pinscreen assembly including:

a frame having a plurality of frame pinholes;

a securement plate including a plurality of securement plate pinholes, the securement plate being configured to translate laterally relative to the frame between an unsecured position and a secured position;

a plurality of pins extending through the frame pinholes and the securement plate pinholes, wherein the plurality of pins can be placed in different ones of the plurality of frame pinholes and plurality of securement plate pinholes; and a backplate configured to prevent the plurality of pins from backing out of the frame pinholes;

an inner bracket configured to urge the securement plate from the unsecured position to the secured position, wherein the pinscreen assembly can be placed in one of a plurality of positions relative to the inner bracket; and a securement mechanism configured to be in a secured configuration to retain the first and second sections in the closed configuration and to keep the securement plate in the secured position via the securement mechanism engaging the inner bracket thereby restraining the plurality of pins against the article in an article conforming arrangement to secure the article in the inner chamber for transport, wherein the securement plate is in the unsecured position so that the plurality of pins are free to translate longitudinally when the securement mechanism is in an unsecured configuration such that the plurality of pins are not restrained in the article conforming arrangement when the first and second sections are in an open configuration.

* * * * *